United States Patent [19]

Brasseur et al.

[11] 4,432,320

[45] Feb. 21, 1984

[54] CONTROL EQUIPMENT FOR ADJUSTING THE MOMENT OF FUEL INJECTION AND/OR AMOUNT OF FUEL SUPPLIED BY A FUEL INJECTION PUMP, FOR INTERNAL COMBUSTION ENGINES

[75] Inventors: Georg Brasseur, Vienna; Gerhard Lehner, Hallein; Peter Herzog, Hallein; Heinz Rathmayr, Hallein; Theodor Stipek, Hallein, all of Austria

[73] Assignee: Friedmann & Maier Aktiengesellschaft, Hallein, Austria

[21] Appl. No.: 378,728

[22] Filed: May 17, 1982

[30] Foreign Application Priority Data

Jun. 10, 1981 [AT] Austria ..... 2585/81

[51] Int. Cl.[3] ..... F02D 31/00

[52] U.S. Cl. ..... 123/357; 123/367; 123/372; 123/501

[58] Field of Search ..... 123/365, 367, 372, 385–388, 123/501, 357; 464/54, 57

[56] References Cited

U.S. PATENT DOCUMENTS

| | | | |
|---|---|---|---|
| 1,967,101 | 7/1934 | Rassbach et al. | 123/372 |
| 2,125,210 | 7/1938 | Trapp | 123/501 |
| 3,407,793 | 10/1968 | Lang | 123/357 |
| 4,252,089 | 2/1981 | Kramer | 123/365 |
| 4,297,979 | 11/1981 | Kamleitner | 123/372 |
| 4,343,274 | 8/1982 | Butscher | 123/357 |

FOREIGN PATENT DOCUMENTS

| | | | |
|---|---|---|---|
| 401738 | 6/1943 | Italy | 123/387 |
| 409568 | 2/1945 | Italy | 123/365 |
| 2029512A | 3/1980 | United Kingdom | 123/387 |

*Primary Examiner*—Charles J. Myhre
*Assistant Examiner*—Magdalen Moy
*Attorney, Agent, or Firm*—Cushman, Darby & Cushman

[57] ABSTRACT

In a control equipment for adjusting the moment of fuel injection and/or the amount of fuel supplied by a fuel injection pump in internal combustion engines, at least one mechanical energy accumulator (9, 10) is provided between an adjusting member (2, 3) for the begin of fuel supply and/or for the amount of fuel supplied and an electrical servomotor (4), said energy accumulator comprising two mutually movable spring collars (12, 13) between which is accommodated a pre-stressed compression spring (11) and the maximum distance of which one from the other is limited by abutments (14, 15) of a housing surrounding the spring collars. (FIG. 1).

11 Claims, 2 Drawing Figures

Figure 1:
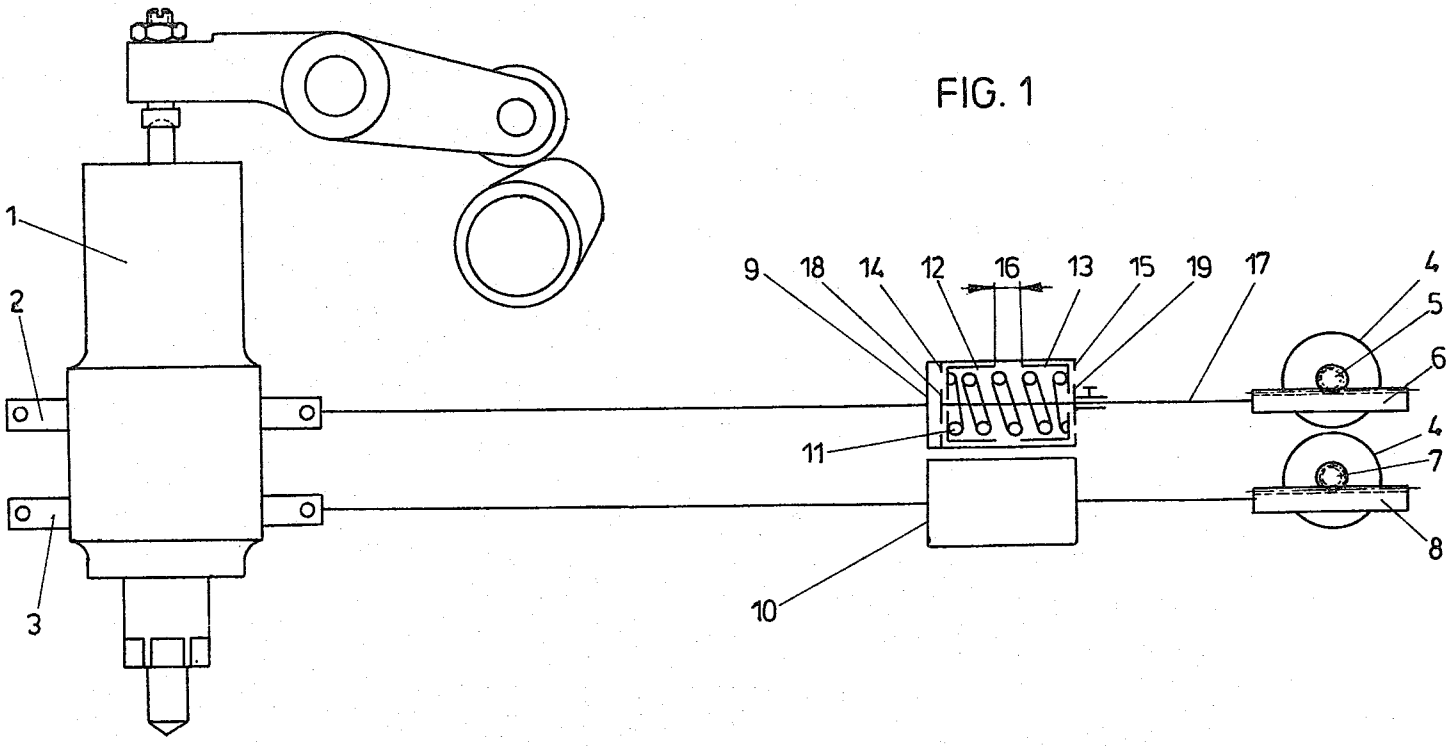

CONTROL EQUIPMENT FOR ADJUSTING THE MOMENT OF FUEL INJECTION AND/OR AMOUNT OF FUEL SUPPLIED BY A FUEL INJECTION PUMP, FOR INTERNAL COMBUSTION ENGINES

The invention refers to a control equipment for internal combustion engines and for adjusting the moment of fuel injection and/or the amount of fuel supplied by a fuel injection pump, in which an adjusting member for adjusting the beginning of fuel supply and/or an adjusting member for adjusting the amount of fuel supplied, particularly a rod carrying dogs for yielding pistons and/or a control rod, is adjusted by an electrical servo-motor, particularly a stepping motor. It is already known to incorporate into control links dragging members and, respectively, force limiting members for reducing or limiting the mechanical stress. Such known constructions serve the purpose of preventing too high a load on the control link and thus fracture or deformation of the control link.

The invention now refers to a control equipment of the initially defined type in which an electric servo-motor, in particular a stepping motor, is used for adjusting the control link. Such electric stepping motors are, as a rule, dimensioned such that their maximum adjusting force is insufficient for damaging the control link. In the case of electro servo-motors or stepping motors this motor is, as a rule, controlled by means of a microprocessor and it is of substantial importance for exactly controlling the moment of fuel injection and the amount of fuel supplied by a fuel injection pump that the respective actual position of the servo-motor coincides with the position presupposed by the microprocessor for the following adjusting step. If, however, an adjusting step is released by the microprocessor and this adjusting step coincides with a fuel supply stroke of the fuel injection pump, adjustment of the adjusting member for the amount of fuel supplied and also adjustment of the adjusting member for the moment of fuel injection is only possible with increased acting force and with correspondingly increased wear. In view of the relatively low adjusting forces of such electrical servo-motors there exists, above all with stepping motors, the danger that individual control steps are completely omitted and that the subsequent control operation lags and becomes inexact.

The invention now aims at reliably providing an exact control of the amount of fuel supplied and of the moment of fuel injection even if in a control equipment of the initially defined type individual control steps of the motor coincide with a fuel supply stroke of the fuel injection pump, and thus at reducing any wear of the adjustment members for the moment of fuel injection and/or for the amount of fuel supplied. For achieving this object, the invention essentially consists in that the electrical servo-motor, particularly the stepping motor, is connected with the respective adjusting member with interposition of at least one mechanical energy accumulator. In this manner one step or several steps of the electrical servo-motor can be stored within the mechanical energy accumulator in case that adjustment would only be possible with increased forces and wear as is the case during the fuel supply stroke of the fuel injection pump. As soon as the fuel supply stroke is terminated, the adjusting steps of the electrical servo-motor, particularly stepping motor, stored within the mechanical energy accumulator are transmitted to the adjusting members of the fuel injection pump, so that the required nominal position is reached with a minimum wear of the adjusting members. By this measure it is also prevented that individual adjusting steps become obstructed to an extent which would detract from the subsequent exact control operation.

According to a preferred further development of the invention, the mechanical energy accumulator is designed as an energy accumulating spring. In this case, the arrangement is preferably such that the energy accumulating spring has two spring collars being movable one relative to the other and having their maximum distance one from the other limited by abutments of a housing surrounding the spring collars, a pre-stressed compression spring being interpositioned between said both spring collars. This construction provides the possibility to pre-adjust the spring force of the mechanical energy accumulator and to adapt this force to the existing requirements by changing the position of the abutments.

Preferably, the inventive arrangement is such that part of a transmitting link is connected with a stepping motor for receiving pushing forces and pulling forces, is extending through both spring collars and carries abutments cooperating with those surfaces of the spring collars which are remote from the compression spring, and that that part of the connecting transmission link which is connected with the adjusting member is connected to the housing. Such a part of a transmission link which serves the purpose of transmitting push and pull can, for example, be formed of a toothed rack meshing with a pinion of the electrical servo-motor or of a nut connected with the driving motor for being rotated and meshing with a spindle. Such a construction reliably stores the adjusting steps for both directions of movement of the adjusting members. If a spiral-shaped slot is used for transmitting the force from the servo-motor to the adjusting member one can do with a simple resiliently compressible energy accumulator.

In an advantageous manner, the spring collars can have abutments on their mutually facing surfaces for limiting the maximum compression stroke of the spring so that an adjustment, which is suddenly required and is exceeding said maximum compression stroke, can be made without considering the thus resulting wear of the adjusting members. This serves the purpose of avoiding inadmissible operating conditions of the fuel combustion engine.

Interposition of an energy accumulator into the transmission path between the electrical servo-motor, particularly stepping motor, and the adjusting member also provides the possibility for safety measures in the case of a failure of the current supply or of the microprocessor. For this purpose, the arrangement is preferably such that at least one abutment is provided in the transmission link between the energy accumulator and the adjusting member for being coupled with a shut-down device being independent from the stepping motor, and that between said abutment and the energy accumulator there is interpositioned at least one further resilient dragging member. In this case, the shut-down device is preferably designed as a piston of a hydraulic cylinder-piston-aggregate, said piston being shiftable against the force of a spring and the working space of the cylinder-piston-aggregate being connectable to a source of hydraulic fluid and the spring force of the shut-down device being greater than the spring force of the resilient dragging member and of the energy accumulator, respectively. The use of such a hydraulic cylinder-piston-aggregate is recommendable particularly because the spring force of this shut-down device must be relatively great for a reliable cutoff in case of a break down of the current supply, of the microprocessor or of the servo-motor. For this purpose, there is preferably interconnected into the conduit for hydraulic fluid leading to the working space of the shut-down device, a valve which is preferably electrically actuated and which, during operation of the internal combustion engine, connects the hydraulic cylinder with a pressurized fluid source and which vents the hydraulic cylinder in case of inadmissible operating conditions such as overspeed and/or failure of the current supply.

The invention is further described in detail with reference to the drawing showing embodiments of the invention.

In the drawing

Figure 2:
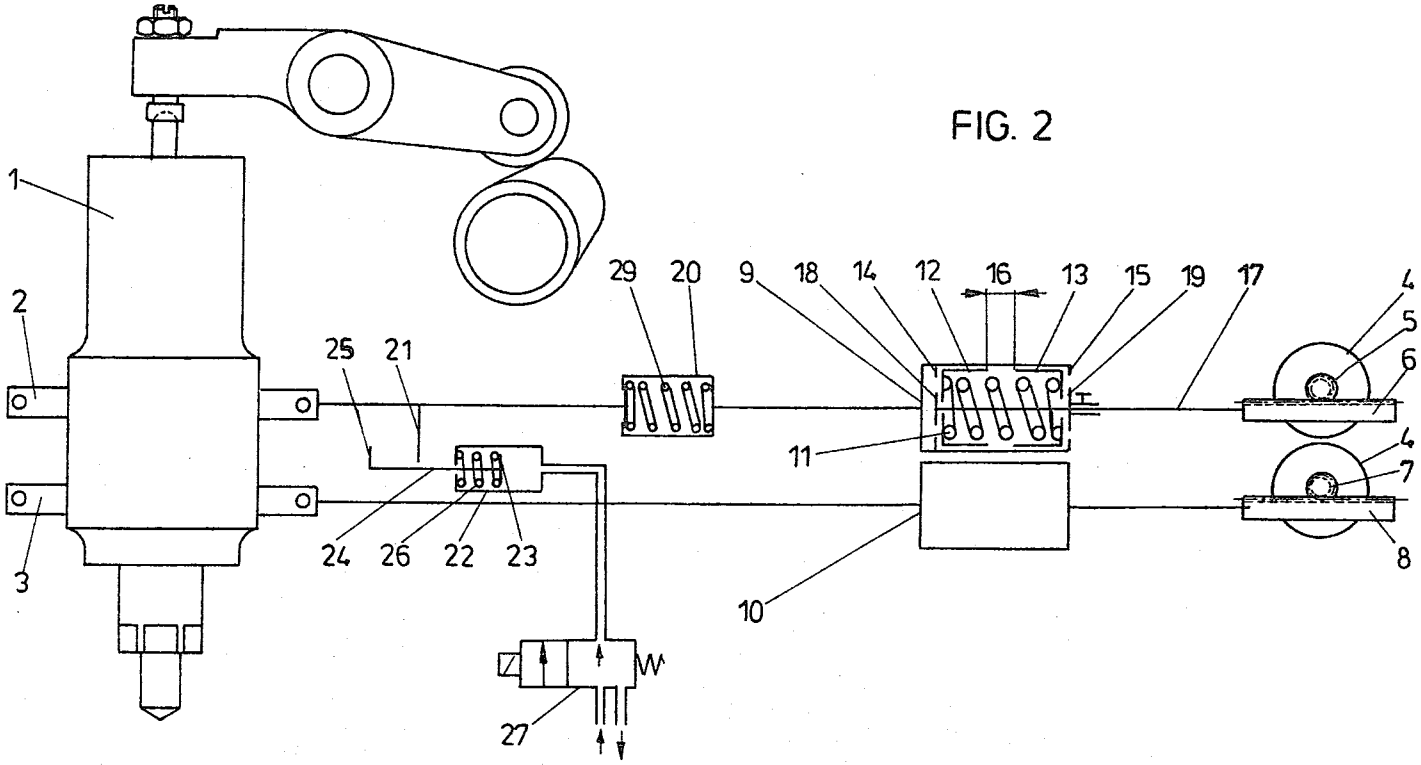

FIG. 1 shows a first embodiment of an energy accumulator according to the invention and FIG. 2 shows the arrangement according to FIG. 1 having, however, incorporated an additional shut-down device.

In FIG. 1 there is shown the unit of pump and nozzle serving the purpose of supplying fuel to an internal combustion engine not shown. In this unit, control of the amount of fuel supplied and control of the begin of fuel supply is in each case effected by means of an adjusting member designed as a push rod 2,3 which is shifted by means of a linking rod means which is driven by an electric servo-motor 4, for example via a pinion/-toothed rack-gear 5,6,7,8, or by a spiral-shaped slot not shown. Control of both said servo-motors is effected via a microprocessor not shown which calculates the nominal values for fuel amount and beginning of fuel supply from operating parameters supplied by sensors and which supplies the required control impulses to the servo-motors via amplifiers. An energy accumulator 9,10 is incorporated into the linking rod means for each of both functionalities and serves the purpose of yielding along a limited path whenever the actuating force within the linking rod means attains a fixed limit and of storing the path additionally controlled by the servo-motor. In the present embodiment, this is effected by the compression spring 11 which presses the both spring collars 12,13 against the abutments 14,15 within the energy accumulator 9 designed as spring bushing. In rest position some play 16 between both spring collars 12,13 is existing. The part 17 of the linking rod means, which is connected with the electric servo-motor for positively transmitting tension forces as well as pushing forces, extends through the spring collars 12,13 and has a fixed abutment 18 and an adjustable abutment 19, the latter being adjusted such that in rest position no play of both spring collars 12,13 exists relative to the abutments 18,19. If the control rods are maintained in fixed position within the pump during a fuel supply stroke and simultaneously the servo-motors exert a control movement, this movement results in changing the length of the compression spring 11 within the spring bushing and within the limits allowed by said play 16. Conveniently the spring 11 is designed and prestressed such that the force of the prestressed spring is about 30 to 50 percent of the force exerted by the servo-motor. The dependency of the shifting force on the adjustment path of the spring shall be small so that the increase in force remains small on any travelling movement over the length of the play 16. As can be derived from FIG. 1, the described energy accumulating action is performed in both directions of movement of the control rod.

FIG. 2 shows an arrangement similar to that of FIG. 1. There is however provided a further resilient dragging member 20 as well as an abutment 21, both cooperating with a shut-down device 22, in the rod link means for controlling the amount of fuel. In case of a failure of the microprocessor on account of a defect of the current supply or in case of a failure of the servo-motor 4 there exists the danger that the internal combustion engine assumes overspeed. For this reason, the amount of fuel supplied must immediately be set back to zero. In the described arrangement, a shut-down device comprising a piston 23, a piston rod 24 and a hook-like coupling member 25 is subjected via a conduit to a fluid pressure, for example the pressure of the motor oil or the pressure of the fuel, so that the spring 26 is tensioned and the piston 23 is pressed together with the coupling member 25 into its left-hand end position in which the piston does not obstruct the movement of the adjusting member 2 for the amount of fuel supplied. In case of a failure of the microprocessor or of the servo motor or with occurrying overspeed, current supply to the solenoid valve 27 is interrupted, the valve assumes open position in outward direction and the fluid pressure within the shut-off device becomes reduced. As a consequence, the spring 26 urges the piston 23 together with the hook-like coupling member in right-hand direction and the control rod is via the abutment 21 pulled in direction corresponding to the value of zero for the fuel supply. Thereby, the pre-stress of the compression spring 29 within the resilient dragging member 20 is overcome and the spring 29 is compressed in correspondence with the required shut-off path. Also the compression spring 11 within the spring bushing 9 is, during this emergency shut-down operation, compressed for overcoming the play 16. Related to the retaining force of the servo-motor exerted during its expected operation, the pre-tension force of the spring 29 within the resilient dragging member 20 is approximately 60 to 90 percent while the force exerted by the spring 26 of the shut-down device 22 is at least 110 percent.

What is claimed is:

1. Control apparatus for a fuel injection pump for an internal combustion engine, said apparatus comprising independent control means for changing the timing of fuel injection and for changing the quantity of fuel injected, at least one of said control means including an adjusting member, an electrical servomotor, connecting means connecting the servomotor with the adjusting member for adjusting the position of the adjusting member in either of two directions, said connecting means including a mechanical energy accumulator, said accumulator comprising a pre-stressed compression spring through which adjusting force is transmitted from the servomotor to the adjusting member in either of two directions, the spring being disposed between two collars which are mutually movable relative to each other, the spring having opposite ends engageable with the collars, and abutment means for limiting the maximum distance between the collars.

2. Apparatus as in claim 1 wherein the connecting means includes two longitudinally aligned link members, said energy accumulator including a housing fixed to one of the link members, the spring and collars being mounted for longitudinal movement in the housing and the abutment means being carried by the housing.

3. Apparatus as in claim 1 wherein the connecting means includes first and second longitudinally aligned link members, the first link member being connected to the servomotor for transmitting pushing forces and pulling forces and extending through said collars and through said spring, said first link member carrying abutments cooperating with those surfaces of the collars which face away from the ends of said spring, and the second link member being connected to the adjusting member and to a housing which surrounds said spring and said collars, said housing carrying said abutment means which limits the maximum distance between the collars.

4. Apparatus as in claim 2 wherein said collars are provided at their mutually facing sides with abutments which limit the minimum distance between the collars.

5. Apparatus as in claim 2 wherein the link member which is fixed to the housing is connected to said adjusting member and is provided with an abutment element and with a resilient dragging member connected between said abutment element and the housing, and a shut-down device actuable by said abutment element.

6. Apparatus as in claim 5 wherein the shut-down device includes a hydraulic cylinder and piston unit having a working space connectable to a source of hydraulic pressure and a spring member against which the piston is shiftable, the force of the spring member being greater than the force of the resilient dragging member.

7. Apparatus as in claim 5 wherein the shut-down device includes a hydraulic cylinder and piston unit having a working space connectable to a source of hydraulic pressure and a spring member against which the piston is shiftable, the force of the spring member being greater than the force of the spring of said energy accumulator.

8. Apparatus as in claim 6 including a valve responsive to normal engine operation to supply hydraulic pressure to the working space of the cylinder and piston unit and responsive to an engine malfunction to relieve hydraulic pressure from the working space.

9. Apparatus as in claim 7 including a valve responsive to normal engine operation to supply hydraulic pressure to the working space of the cylinder and piston unit and responsive to an engine malfunction to relieve hydraulic pressure from the working space.

10. Apparatus as in claim 5 wherein said at least one control means is the control means for changing the quantity of fuel injected.

11. In a fuel injection pump for an internal combustion engine: independent control means for changing the timing of fuel injection and for changing the quantity of fuel injected, at least one of said control means including an adjusting member movable in two directions, a servomotor, connecting means connected between the adjusting member and the servomotor for transmitting push-pull forces from the servomotor to the adjusting member, said connecting means including two link members, and a mechanical energy accumulator connected between said link members, said accumulator including a helical spring, a collar engageable with each end of the spring, one end portion of one of said link members extending through the spring and through the washers and carrying two spaced-apart abutments between which the spring and washers are located, and spaced-apart abutment members carried by an end portion of the other link member, said abutment members being spaced from and engageable by the collars so as to limit the maximum distance between the collars.

* * * * *